US005209004A

United States Patent [19]

Kirlin

[11] Patent Number: 5,209,004

[45] Date of Patent: May 11, 1993

[54] WEATHERPROOF DISPLAY DEVICE

[76] Inventor: Dawian D. Kirlin, 7901 Porsche, Anchorage, Ak. 99502

[21] Appl. No.: 857,229

[22] Filed: Mar. 25, 1992

[51] Int. Cl.[5] ..... G09F 3/18

[52] U.S. Cl. ..... 40/642; 248/909; 40/661

[58] Field of Search ..... 40/642, 645, 649, 661, 40/611, 593, 152, 333, 312, 319, 607; 248/909

[56] References Cited

U.S. PATENT DOCUMENTS

| | | | |
|---|---|---|---|
| 1,285,890 | 11/1918 | Anderson | 40/312 X |
| 2,093,598 | 9/1937 | Clark | 40/642 |
| 2,297,574 | 9/1947 | McCord . | |
| 3,174,608 | 3/1965 | Knickerbocker . | |
| 3,478,456 | 11/1969 | Mundt et al. | 40/152 |
| 3,533,178 | 10/1970 | Strohmaier | 40/593 X |
| 4,144,664 | 3/1979 | De Korte . | |
| 4,231,174 | 11/1980 | Thompson . | |

FOREIGN PATENT DOCUMENTS

| | | | |
|---|---|---|---|
| 820754 | 11/1937 | France | 40/611 |

*Primary Examiner*—Kenneth J. Dorner
*Assistant Examiner*—J. Bonifanti
*Attorney, Agent, or Firm*—Richard C. Litman

[57] ABSTRACT

A weatherproof display device for displaying changeable printed information such as publication title, significant headlines, or other data in a highly visible manner suitable for out-of-doors advertising on coin controlled newspaper vending machines is disclosed. The device includes a rectangular housing fitted with a transparent panel retaining printed materials inserted within the housing in an upright manner and permitting such to be readily observed by passersby. An integral mounting bracket permits the device to be joined to coin controlled newspaper vending machines produced by a variety of manufacturers.

1 Claim, 2 Drawing Sheets

WEATHERPROOF DISPLAY DEVICE

FIELD OF THE INVENTION

The present invention relates generally to protective holders for boards, posters, or placards publicly displayed to advertise, impart information, or give directions.

BACKGROUND OF THE INVENTION

The United States of America was founded upon the premise that only through the free flow of ideas could its citizens retain their liberty in a democratic society. Our Founding Fathers believed so strongly in this principle that freedom of speech was guaranteed by the Bill of Rights which they adopted as the law of the land. Today, as in the earliest days of our country's history, one of the leading means for disseminating ideas is the newspaper.

Hardly a street corner exists in a large metropolitan area of the United States that presently lacks a coin controlled newspaper vending machine. Each of these machines typically provides a windowed cabinet permitting the public to scan the cabinet contents and newspaper headlines prior to making a purchase if so disposed. Below the door on the front of the cabinet there may be provided a suitable rack to receive and display changeable exhibitor cards, such as those bearing the title of the publication to be dispensed, significant headlines or other data. Because of their proximity to the ground, these display racks cannot be viewed readily by passersby and are thus limited in their effectiveness. The need presently exists for a weatherproof display device for attachment to a coin controlled newspaper vending machine that may be readily viewed by passersby.

DESCRIPTION OF THE RELATED ART

Over time, devices have been developed for publicly displaying advertisements and the like. These devices generally retain a sign in an upright position for exhibition purposes and provide some protection from the environment. None of these devices, however, are particularly well suited for mounting onto an apparatus, such as the coin controlled newspaper vending machine disclosed in U.S. Pat. No. 3,174,608 issued Mar. 23, 1965 to Knickerbocker.

U.S. Pat. No. 2,297,574 issued Sep. 29, 1942 to McCord discloses a card display device for simultaneously exhibiting two different sized display cards. To the casual observer of the device in use, the smaller card appears to be mounted upon and framed by the larger card. In this manner, the display of a small foreground photograph in conjunction with a large background card may be accomplished. This device has no means, such as a lid or protective cover, for protecting the display cards from the weather. Additionally, the device's decorative base lacks a means for securing such to an immovable surface; thus the device may be easily carried off from a public place by one unauthorized to do so.

U.S. Pat. No. 4,144,664 issued Mar. 20, 1979 to De Korte shows a weatherproof changeable display device including a thin rectangular box assembly formed by interlocking front and back panels made of transparent material having a base assembly forming a mounting pedestal and a securing cap forming its top edge and serving as its cover. While the base assembly may be fitted with appropriate hardware and firmly secured to an immovable object, the box assembly is simply friction fit within the base and remains subject to unauthorized removal or theft.

U.S. Pat. No. 4,231,174 issued Nov. 4, 1980 to Thompson provides a protective holder for sheet material having a flat rectangular envelope with at least one transparent wall and elongated mounting margins along two side edges of the envelope, each having longitudinally spaced mounting apertures to enable the mounting of the envelope on a suitable support. The device may be tied to a vehicle steering wheel or used in a photograph album. The lightweight nature of this device makes it unsuitable for prolonged exposure to the elements and human contact in a public setting.

None of the above inventions and patents, taken either singly or in combination, is seen to describe the instant invention as claimed.

SUMMARY OF THE INVENTION

The principal object of this invention is to provide a simple, inexpensive, dependable, easily maintainable device for displaying changeable printed information in a highly visible manner suitable for out-of-doors advertising on coin controlled newspaper vending machines.

It is another object of the instant invention to provide a weatherproof display device which is adaptable to retain various forms of printed matter on flexible sheets of various compositions including: paper, cardboard, and plastic.

It is a further object of the invention to provide a weatherproof display device which need not be disassembled prior to placement of printed matter therein.

These and other objects of the present inventive weatherproof display apparatus will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
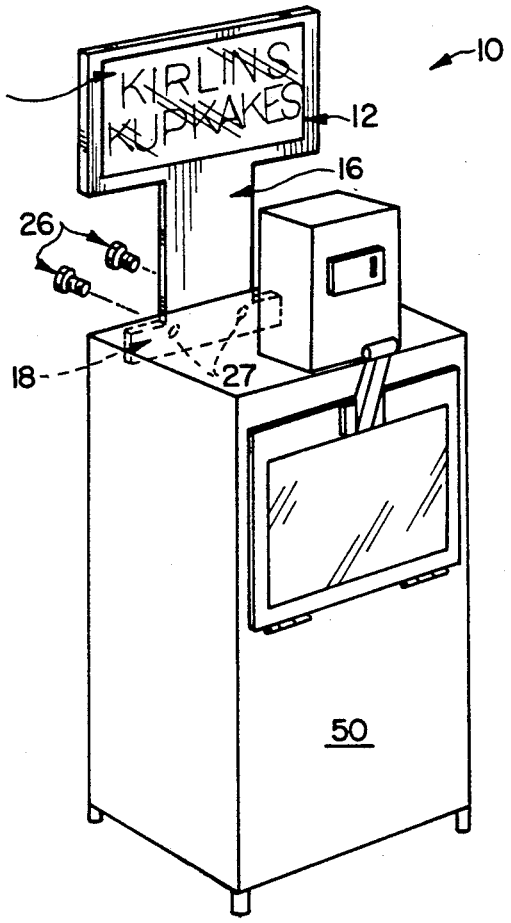
FIG. 1 is a perspective view of a weatherproof display device in accordance with this invention mounted upon a coin controlled newspaper vending machine.

With reference now to the drawings and more particularly to FIG. 1 thereof, there is shown a perspective view of an embodiment of the invention mounted upon a coin controlled newspaper vending machine 50. The weatherproof display device, denoted by reference number 10, consists of four primary components: housing 12, transparent plate 14, vertical support member 16, and mounting bracket 18. In the preferred embodiment of the device, housing 12, member 16, and bracket 18 are integrally formed of rigid plastic material. Nevertheless, it is envisioned that each component may be manufactured separately of plastic or other suitable materials and later joined to form the inventive device.

Figure 4:
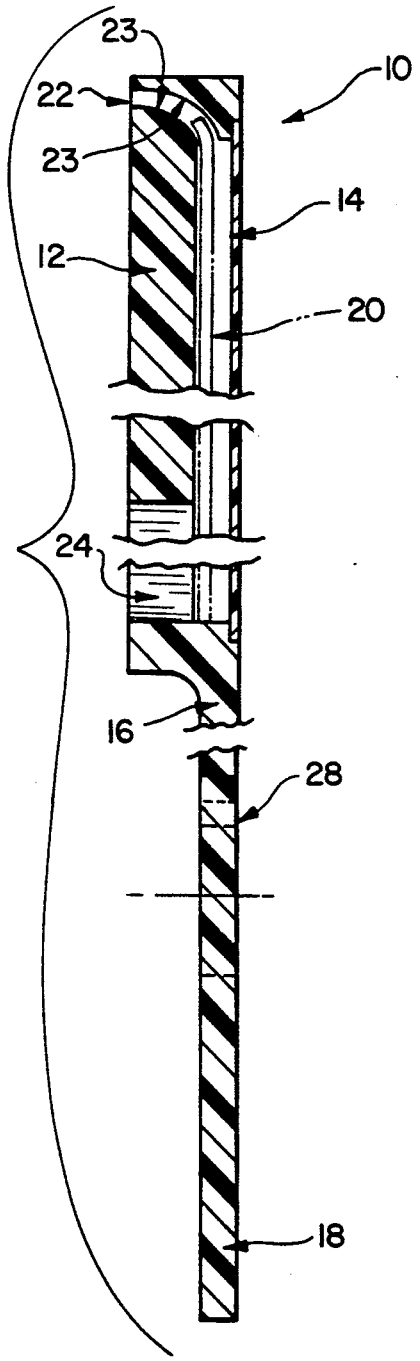
FIG. 4 is a longitudinal section taken along line 4—4 of FIG. 2.
Figure 5:
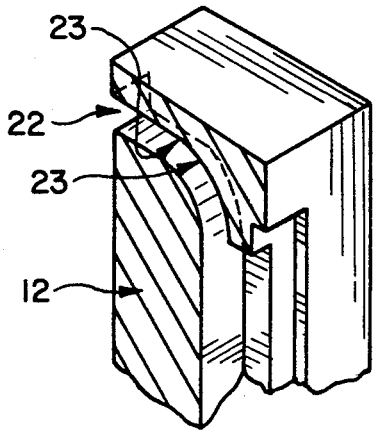
FIG. 5 is a enlarged perspective view of the upper right-hand corner of the housing, transparent plate removed, with portions cut and broken away to show interior details thereof.

When joined, housing 12 and plate 14 form a narrow box whose interior walls support sheets of printed material 20, best seen in FIG. 4, inserted therein in a substantially vertical manner. As plate 14 is transparent, printed material 20 may be readily observed from the exterior of the device. In the preferred embodiment, housing 12 and plate 14 are joined with adhesive cement. However, mechanical means, well known in the fastening art, may be employed for this purpose.

Figure 3:
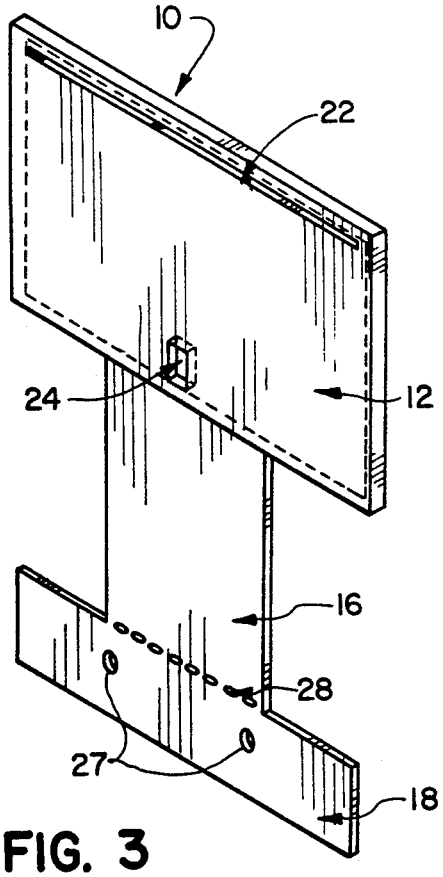
FIG. 3 is a perspective view of the device shown in FIG. 2 showing the rear of the device.
Figure 2:
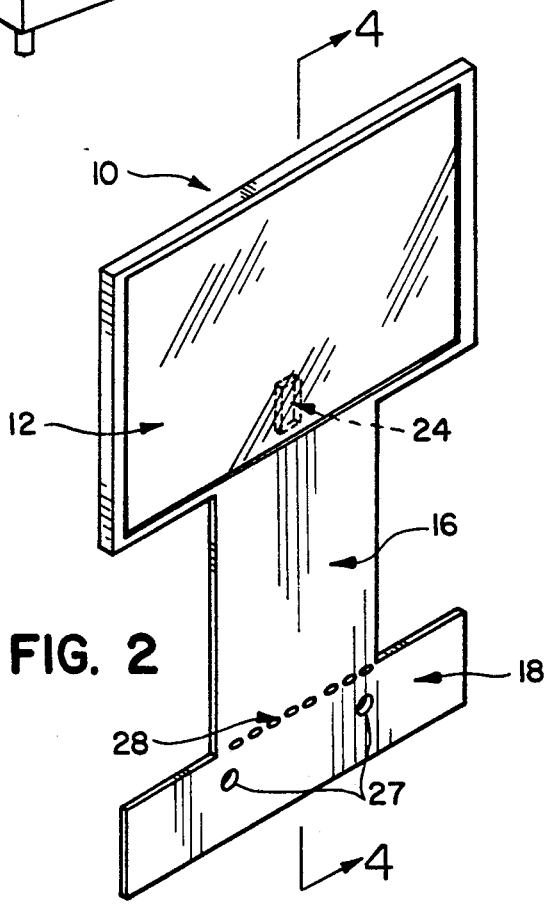
FIG. 2 is a perspective view of a weatherproof display device in accordance with this invention showing the front of the device.

Printed material may be inserted into the device without disassembly thereof through a narrow and horizontal slot 22 within housing 12 best seen in FIGS. 3 and 4. Material placed within the opening or slot 22 is guided toward plate 14 by the slot's downwardly sloping and guide surfaces 23 defining a downwardly sloping curved guide. The narrow width of slot 22 prevents precipitation or other wind borne debris from entering into the device and damaging printed materials inserted within.

An access hole 24 located below slot 22 permits printed materials inserted within housing 12 to be manipulated. Printed materials may be moved within housing 12 with the push of a finger. A vertical push will direct the materials upward toward slot 22 for removal from the device. In the preferred embodiment of the invention, access hole 24 has been placed in the bottom portion of housing 12 permitting debris or precipitation which may enter the device in unusual situations to drain therefrom.

The present inventive device may be mounted upon coin controlled newspaper vending machines of various configurations. A large number of these vending machines are currently manufactured with holes for securing such with cables or chains to immovable objects to prevent unauthorized movement thereof. Mounting bracket 18 may be equipped with similarly spaced holes 27 permitting threaded fasteners, such as those indicated at 26 in FIG. 1, to readily join the device to a newspaper vending machine. Mounting of the inventive device upon a newspaper vending machine not having such holes, or not capable of being bored by a drill, may be accomplished with double-sided adhesive tape, not shown in the figures, placed upon vertical support member 16. To enhance the attractiveness of the device when not utilizing threaded fasteners for mounting purposes, bracket 18 may be detached from vertical support member 16 by the application of a sheering moment across perforations 28 placed within member 16.

The device of this invention may also be used for other advertising and display purposes and is not intended to be limited for use solely as an attachment to a coin controlled newspaper vending machine. It is contemplated that the device may be used in applications ranging from the posting of signs in parks or other wilderness areas upon fences to providing data concerning a patient confined to a hospital bed to which the device is joined.

While the invention has been illustrated and described in one embodiment, it is recognized that variations and changes may be made therein without departing from the invention set forth in the following claims. It is, therefore, to be understood that the present invention is not limited to the sole embodiment described above, but encompasses any and all embodiments within the scope of the following claims.

I claim:

1. A weatherproof display device for displaying changeable printed materials upon a coin controlled newspaper vending machine comprising:

a housing for substantially vertical support of printed materials therein, said housing having a downwardly sloping curved guide permitting the insertion and removal of printed materials, said housing also having an access hole for manipulation of printed materials therein;

a transparent plate joined to the front of said housing, said plate permitting the printed materials inserted within said housing to be readily observed from the exterior of said device;

a vertical support member joined to said housing, said vertical support member having perforations therein;

a mounting bracket joined to said vertical support member, said bracket having a plurality of holes permitting attachment to a coin controlled newspaper vending machine; and, said housing, vertical support member, and mounting bracket being integrally formed of rigid plastic material.

* * * * *